United States Patent [19]

Kephart

[11] Patent Number: 4,791,695

[45] Date of Patent: Dec. 20, 1988

[54] ARTIST'S BRUSH

[76] Inventor: Evelyn K. Kephart, 813 Logan Blvd., Hollidaysburg, Pa. 16648

[21] Appl. No.: 72,541

[22] Filed: Jul. 13, 1987

[51] Int. Cl.[4] ..... A46B 9/02

[52] U.S. Cl. ..... 15/160; 15/210.5; 101/372; D4/130

[58] Field of Search ..... 15/160, 191–195, 15/166, 159 R, 210.5, 223; 101/372, 373, 327, 397, 399; D4/130–136

[56] References Cited

U.S. PATENT DOCUMENTS

| | | | |
|---|---|---|---|
| D. 23,367 | 6/1948 | Miles . | |
| D. 26,154 | 10/1886 | Hawkins | D4/130 |
| D. 132,113 | 4/1942 | Clements . | |
| 455,740 | 7/1891 | Consene | 15/192 |
| 1,319,493 | 10/1919 | Severance . | |
| 2,247,622 | 7/1941 | Thompson . | |
| 2,662,240 | 12/1953 | Perkins . | |
| 2,736,051 | 2/1956 | Boodakian . | |
| 2,777,145 | 1/1957 | Krieger et al. | 15/191 R X |
| 3,669,069 | 6/1972 | Bourboulis | 15/210.5 X |
| 4,030,414 | 6/1977 | McGuire | 15/210.5 X |
| 4,088,413 | 5/1978 | Rossignol de la Ronde et al. . | |
| 4,483,036 | 11/1984 | Sayklay . | |

FOREIGN PATENT DOCUMENTS

| | | | |
|---|---|---|---|
| 618571 | 9/1935 | Fed. Rep. of Germany | 101/372 |
| 380290 | 3/1940 | Italy | 101/373 |

*Primary Examiner*—Peter Feldman

*Attorney, Agent, or Firm*—Dennison, Meserole, Pollack & Scheiner

[57] ABSTRACT

An artist's brush including handle-mounted bristles of curvilinear configuration and including an outer edge with adjacent elongate portions, one of which is arcuate with a tapered section defined by progressively shorter bristles.

11 Claims, 1 Drawing Sheet

ARTIST'S BRUSH

BACKGROUND OF THE INVENTION

Beginning artists, and particularly children first being introduced to the idea of reproducing reasonable representations of natural shapes such as leaves, flower petals, clouds and hills, tend to encounter difficulties when using conventional round or flat artist's brushes.

While conventional artist's brushes are and have always been more than adequate for the skilled artist, the novice, unsure of his or her ability, could greatly benefit from a brush which, by its very shape, is capable of reproducing basic configurations as an encouraging assist to the novice.

An example of an artist's brush which is, in effect, a painting aid, will be noted in U.S. Pat. No. 4,483,036, Alex R. Sayklay, Nov. 20, 1984. The Sayklay brush provides a plurality of tiered layers of bristles arranged to form a plurality of furcations to create an effect of spaced leaves.

SUMMARY OF THE INVENTION

The artist's brush of the invention is a bristle brush wherein the bristles form an elongate paint applying element or head of a generally curvilinear or sinuated configuration. This configuration basically defines longitudinally continuous oppositely arcing portions. The outer edge of the bristles, along the full length of the paint head, will taper to provide both a fine edge for line definition and an angled face for shading and the like.

The curvilinear or sinuated configuration and the fine edge provide a reproducible pattern simulating, as an example, one edge of a leaf whereby both edges of the leaf can be defined by the brush edge through a rotation of the brush 180°.

The brush, in addition to comprising means for outlining leaves with a great degree of accuracy, can also, through simple manipulations thereof, provide for appropriate shading and detailing. To facilitate shading, the bristles toward one side of the paint head are progressively shortened to define a lower edge section at approximately a 30° angle to the remainder of the lower edge. This provides, in effect, a relief area at the side edge of the brush head which allows the lower arcuate edge to more completely engage the paper when the brush is tilted for shading.

The basic curvilinear configuration of the bristles also enables use of the brush by a novice to form other repetitive configurations such as clouds, rolling mountain tops, and the like. Within the parameters of the invention, variations can be obtained by the use of the brushes with different amplitudes or degrees of arc for the oppositely directed arcuate portions. As an example, the bristles can be configured to produce a wide flower petal as opposed to a long slender leaf.

DESCRIPTION OF PREFERRED EMBODIMENT

Figure 1:
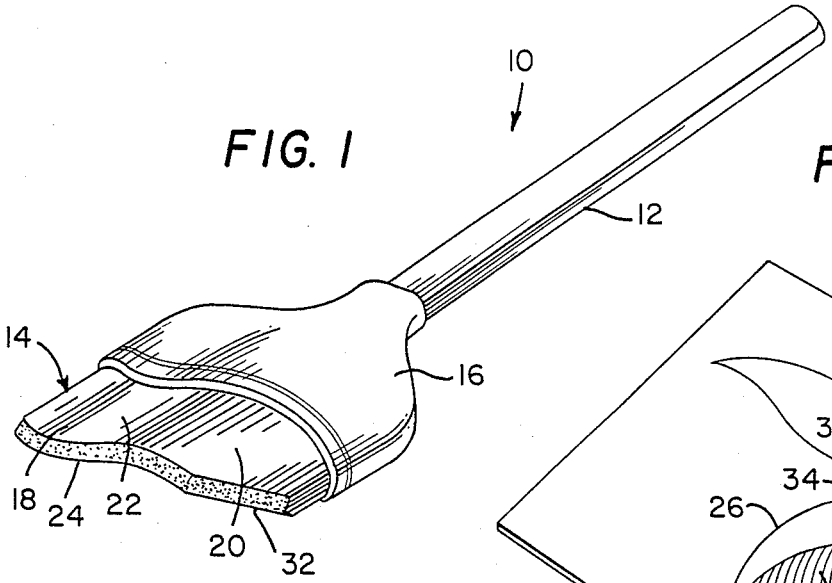
FIG. 1 is a perspective view of the artist's brush of the invention.

Referring now more specifically to the invention, the brush 10, in the manner of a conventional brush, includes a handle 12 and bristles 14 secured to the handle by a ferrule 16.

The bristles 14 define a thin elongate paint applying element or head of generally curvilinear or sinuated configuration incorporating a pair of longitudinally spaced oppositely arcing portions 18 and 20 with a smooth transition area 22 therebetween.

The actual configuration of the bristles 14 will normally be defined by the configuration of the bristle-mounting ferrule 16. This will be appreciated from the drawings wherein the ferrule 16 is sinuated along the bristle-receiving edge thereof with the bristles 14 projecting from and following the configuration of this edge. The ferrule 16 inward of the bristle-receiving edge tapers to a handle-receiving neck portion.

The outer ends of the bristles 14 remote from the ferrule 16 are tapered, preferably at approximately 45°, to either one or both sides to define a sharpened or fine edge 24 along the full length of the bristles 14 between the opposed side edges of the paint head.

Figure 3:
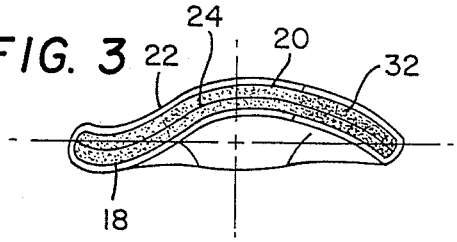
FIG. 3 is an edge view of the bristle end of the brush.

Noting FIG. 3 in particular, in the basic configuration of the brush the oppositely directed arcuate portions 18 and 20 will normally extend laterally to opposite sides of a common base line or plane between the opposed side edges of the paint head with the amplitude of one arcuate portion 20 being substantially greater than that of the other oppositely directed arcuate portion 18.

Figure 4:
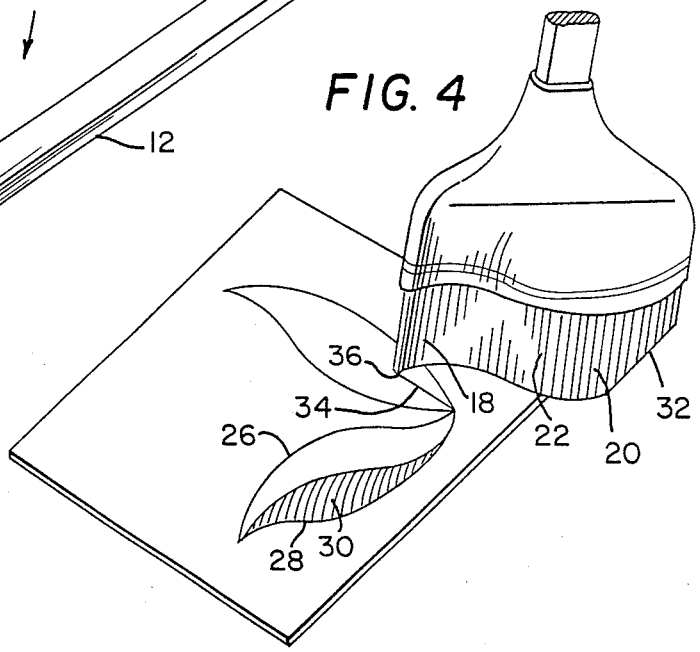
FIG. 4 suggests proposed manners of use of the brush in the formation of leaf outlines, veins, etc.
Figure 2:
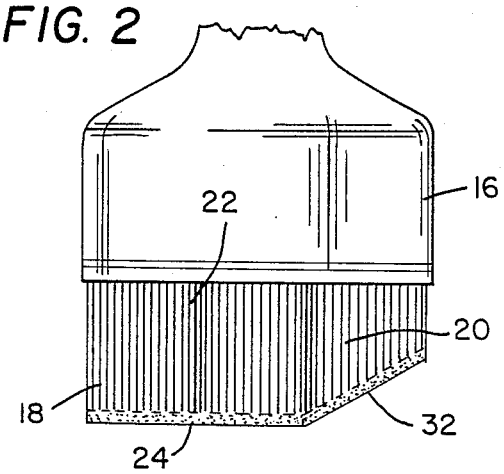
FIG. 2 is a front elevational view of the bristle end of the brush.

The resultant illustrated sinuated configuration is particularly adapted for use in the formation of leaves as suggested in FIG. 4. In forming a leaf, and after immersing the bristles 14 in paint, the full extend of the sharpened outer edge 24 is applied against the surface to define a first leaf edge 26. The brush is then rotated and an opposed companion edge 28 produced by again engaging the fine lower edge 24 of the bristles. The sinuated configuration of the bristle edge 24 will define, as illustrated, a close approximation of a leaf.

Figure 5:
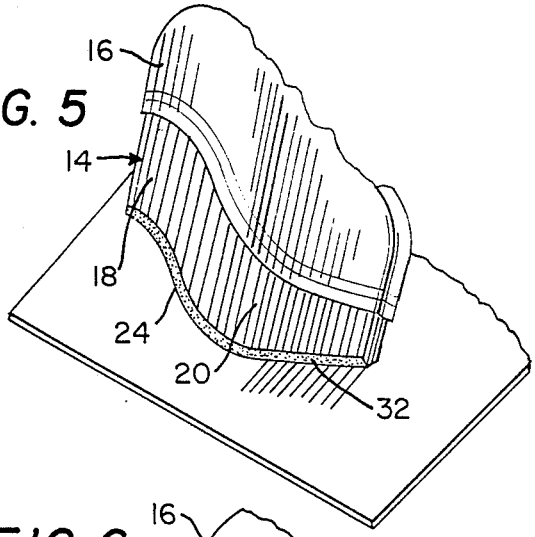
FIG. 5 illustrates the brush positioned to engage the angled edge section for shading purposes.
Figure 6:
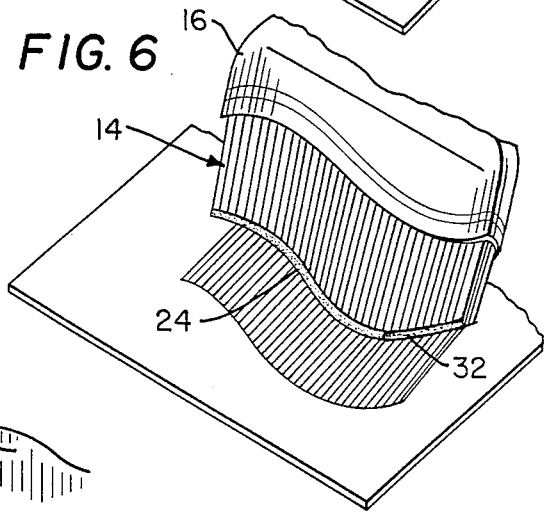
FIG. 6 illustrates the manner in which the angled lower edge section allows for substantially full engagement of the lower edge upon a tilting of the brush and notwithstanding the curvilinear configuration.

As noted in FIG. 4, the leaf illustration can be enhanced by an appropriate brushing or pulling of the bristles partially inward of one or more of the formed sinuated edge lines 26 and 28 to define a shaded area 30. In order to facilitate use of the brush 10 for shading purposes, the bristles, from approximately the midpoint of the greater arcuate portion 20 to the adjacent side of the paint head, are preferably progressively shorter, thus defining an angled edge length or section 32. The angled edge section 32 extends at approximately 30° to the remainder of the bristle edge 24 with the recessed or relieved nature of this section 32 enabling the user to laterally tilt the brush 10 and obtain line contact for at least a major portion of the length of edge 24, note FIG. 6, for use of substantially the entire length of the brush head for shading and the like. So positioned, only the extreme outer end area of the lesser arced portion 18, depending on the extent of the arc, may not engage the surface. In addition, by engaging only the substantially straight angled edge section 32, as suggested in FIG. 5, narrower bands of shading can be produced.

While the angular relieved section 32 enhances the use of the brush for shading purposes, it will necessitate, with the brush held vertical for edge line definition, a slight longitudinal rocking of the brush along the edge 24 to produce a full leaf edge 26 or 28 as shown in FIG. 4. As suggested by the orientation of the brush in FIG. 4, leaf veins 34 can be drawn using the sharply defined end corner 36 of the bristle edge 24 opposed from the angle edge section 32. The versatility of the sinuated bristles 14 in providing shading, interlineation, and the like is limited only by the skill and imagination of the user of the brush. However, as noted above, even a novice can obtain an accurately formed leaf without difficulty and in a manner which can only encourage a beginning artist.

Figure 7:
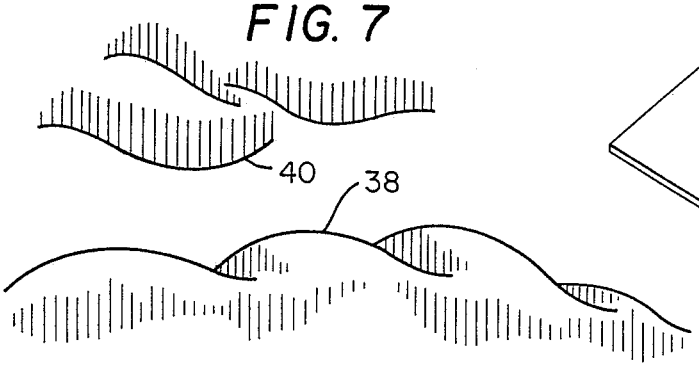
FIG. 7 represents other formations reproducible by the brush.

As suggested in FIG. 7, the sinuated bristles 14, in addition to forming leaves and the like, can be used to provide repeating patterns of simple although realistic representations of mountains 38 and clouds 40, each of which can be enhanced by a selective inward sweeping or pulling of the bristles relative to the edge-defined line which provides the basic outline or configuration.

The basic configuration of the bristles includes a pair of oppositely arcing portions 18 and 20 as portions of a sinuated shape wherein each portion smoothly merges into the other. Within this basic configuration, the invention contemplates variations in the degree of curvature or amplitude of the two portions 18 and 20 relative to a base line or plane. For example, substantially greater arcs, as compared to the rather flat arcs illustrated in FIG. 3, might be desired should it be the primary purpose of the brush to be used in the formation of flower petals. Alternatively, the portion 18 can be substantially linear with the desired curvilinear configuration being defined by the arcuate portions 20 and the arcuate transition length 22 between portions 18 and 20. Further, brushes of various sizes, each maintaining the basic configuration disclosed, can be provided for use in the formation of a variety of features, including multiple-layer flower petals.

Other uses of the brush will be recognized by both the skilled artist and, through use, by the novice, particularly in the area of highlighting, shadow formation, and the presentation of materials, free-flowing forms, and the like.

I claim:

1. An artist's brush configured for the reproduction of repetitive patterns, said brush including a handle with a paint applying element thereon, said paint applying element projecting from said handle and terminating in an elongate outer edge remote from said handle, said paint applying element having opposed side edges, said outer edge terminating in opposite ends at said opposed side edges, said outer edge including a pair of elongate portions, one adjacent each side edge, each of said portions being of an arcuate configuration with a smooth transition length between said portions, said portions being oppositely directed relative to each other and extending to the opposite sides of a common base line between the opposed ends of the outer edge, said paint applying element being defined by bristles.

2. The artist's brush of claim 1 wherein said paint applying element, for a length thereof along one arcuate configuration portion, is progressively shorter toward the adjacent one of said side edges and defines an outer edge section extending at an arcuate angle to a linear continuation of the remainder of said outer edge.

3. The artist's brush of claim 2 including a ferrule between said handle and said paint applying element, said ferrule mounting said element on said handle, said paint applying element being of a constant cross-sectional configuration with said outer edge between said outer edge and said ferrule.

4. The artist's brush of claim 3 wherein said ferrule defines the configuration of said paint applying element and the outer edge thereof.

5. An artist's brush configured for the reproduction of repetitive patterns, said brush including a handle with a paint applying element thereon, said paint applying element projecting from said handle and terminating in an elongate outer edge remote from said handle, said paint applying element having opposed side edges, said outer edge terminating in opposite ends at said opposed side edges, said outer edge including a pair of elongate portions, one adjacent each side edge, one of said portions being of an arcuate configuration with a smooth transition length between said portions, said paint applying element, for a length thereof along said arcuate configuration portion, being progressively shorter toward the adjacent side edge and defining an outer edge section extending at an arcuate angle to a linear continuation of the remainder of said outer edge.

6. An artist's brush configured for the production of curvilinear shapes, said brush including bristles defining an elongate outer edge, said outer edge having opposed ends and following a curved configuration between said opposed ends, said outer edge comprising two adjacent elongate portions at least one of which is of an arcuate configuration terminating at one of said ends, said bristles at said arcuate configuration portion of the outer edge being progressively shorter from an intermediate point along the length of the arcuate configuration portion to said one of said ends to define a tapered section along said outer edge.

7. The artist's brush of claim 6 wherein the tapered section extends at an acute angle to a linear continuation of the remainder of said outer edge.

8. The artist's brush of claim 7 wherein said bristles define a fine line along said outer edge.

9. The artist's brush of claim 8 wherein the configuration of the outer edge is constant throughout the height of said bristles inward of said outer edge.

10. The artist's brush of claim 9 wherein the second of said elongate portions is of arcuate configuration terminating at the second of said ends.

11. The artist's brush of claim 10 wherein said arcuate configuration portions extend to the opposite sides of a common base line between the opposed ends of the outer edge.

* * * * *